US007575523B2

(12) United States Patent
Yokota

(10) Patent No.: US 7,575,523 B2
(45) **Date of Patent: *Aug. 18, 2009**

(54) GOLF CLUB HEAD

(75) Inventor: Masatoshi Yokota, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 157 days.

This patent is subject to a terminal disclaimer.

(21) Appl. No.: 11/643,673

(22) Filed: Dec. 22, 2006

(65) Prior Publication Data

US 2007/0161433 A1 Jul. 12, 2007

(30) Foreign Application Priority Data

Jan. 10, 2006 (JP) ..... 2006-002741

(51) Int. Cl.
*A63B 53/04* (2006.01)

(52) U.S. Cl. ..... 473/332; 473/337; 473/345; 473/349; 473/350

(58) Field of Classification Search ..... 473/324–350
See application file for complete search history.

(56) References Cited

U.S. PATENT DOCUMENTS

| | | | | |
|---|---|---|---|---|
| 2,163,091 | A * | 6/1939 | Held | 473/338 |
| 5,316,305 | A * | 5/1994 | McCabe | 473/332 |
| 5,385,348 | A * | 1/1995 | Wargo | 473/338 |
| 5,492,327 | A | 2/1996 | Biafore, Jr. | |
| 5,776,011 | A * | 7/1998 | Su et al. | 473/345 |
| 6,592,468 | B2 * | 7/2003 | Vincent et al. | 473/334 |
| 6,811,496 | B2 * | 11/2004 | Wahl et al. | 473/334 |
| 7,121,956 | B2 * | 10/2006 | Lo | 473/335 |
| 2005/0148405 | A1 * | 7/2005 | Imamoto | 473/338 |
| 2005/0192116 | A1 | 9/2005 | Imamoto | |
| 2006/0100029 | A1 * | 5/2006 | Lo | 473/338 |
| 2008/0009366 | A1 * | 1/2008 | Lo | 473/335 |

FOREIGN PATENT DOCUMENTS

| | | | |
|---|---|---|---|
| JP | 7-213656 | A | 8/1995 |
| JP | 2003-260153 | A | 9/2003 |

* cited by examiner

*Primary Examiner*—Sebastiano Passaniti
(74) *Attorney, Agent, or Firm*—Birch, Stewart, Kolasch & Birch, LLP

(57) ABSTRACT

A golf club head comprises a head main body being provided with at least one hole having a helical groove on its inner surface, and a damper having a thread on its outer surface and screwed to the hole of the head main body, the damper being made of elastic material at least partially for absorbing vibration of the head main body.

19 Claims, 8 Drawing Sheets

GOLF CLUB HEAD

BACKGROUND OF THE INVENTION

1. Field of the Invention

The present invention relates to a golf club which comprises a head main body and a damper for absorbing vibration of the head main body, more particularly to a golf club head being capable of easy to fix the damper to the head main body tightly while keeping high absorbing performance of vibration.

2. Description of the Related Art

Conventionally, in order to absorb an impact force at a time of hitting a ball, there has been proposed a golf club head in which an elastic member is adhered to a back side of a face portion using adhesive. In the club mentioned above, however, the elastic member tends to break away in accordance with the use.

Further, a golf club head with an elastic member sandwiched between a head main body and a face plate has been proposed. However, it is not easy to fix the elastic material between the head main body and the face plate with accuracy and tightly. Also, production efficiency of such a club head is deteriorated, and maintenance operations of the elastic material are hard.

SUMMARY OF THE INVENTION

Therefore, a main object of the present invention is to provide a golf club head being capable of easy to fix the damper to the main body tightly while keeping high absorbing performance of vibration.

According to the present invention, a golf club head comprises a head main body being provided with at least one hole having a helical groove on its inner surface, and a damper having a thread on its outer surface and screwed to the hole, the damper being made of elastic material at least partially for absorbing vibration of the head main body.

DESCRIPTION OF THE PREFERRED EMBODIMENTS

Embodiments of the present invention will now be described in detail in conjunction with the accompanying drawings.

Figure 2:
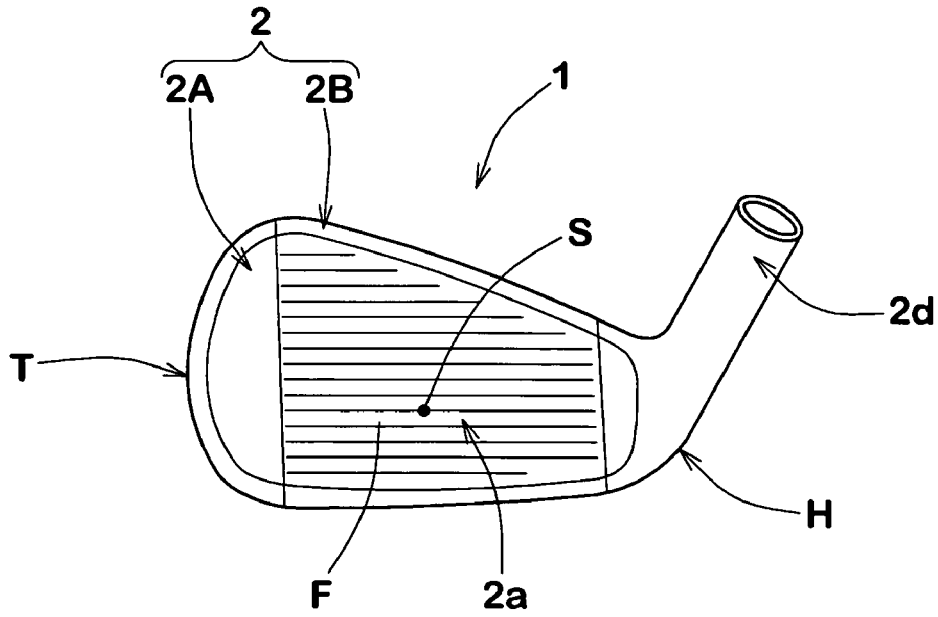
FIG. 2 is a front elevational view of FIG. 1.
Figure 3:
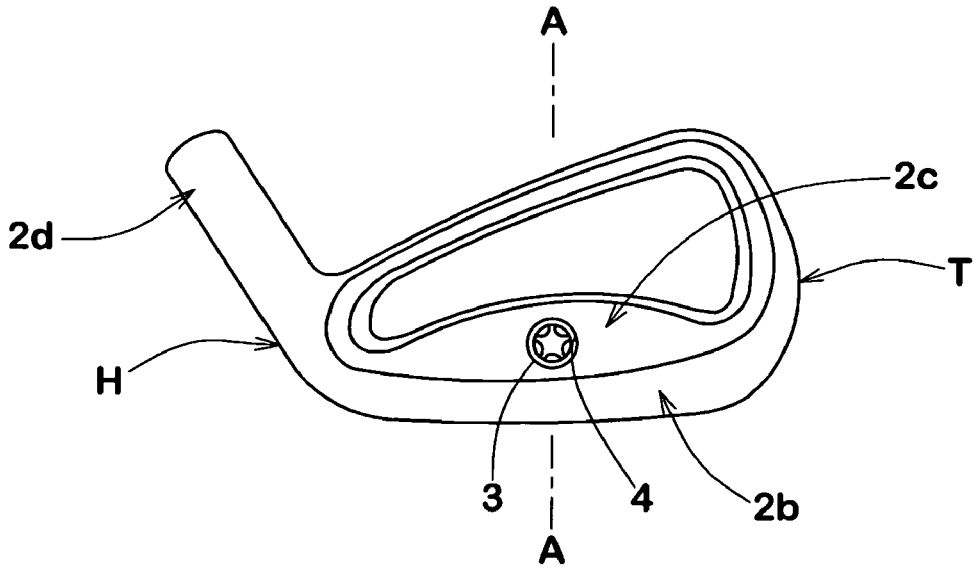
FIG. 3 is a back elevational view of FIG. 2.
Figure 4:
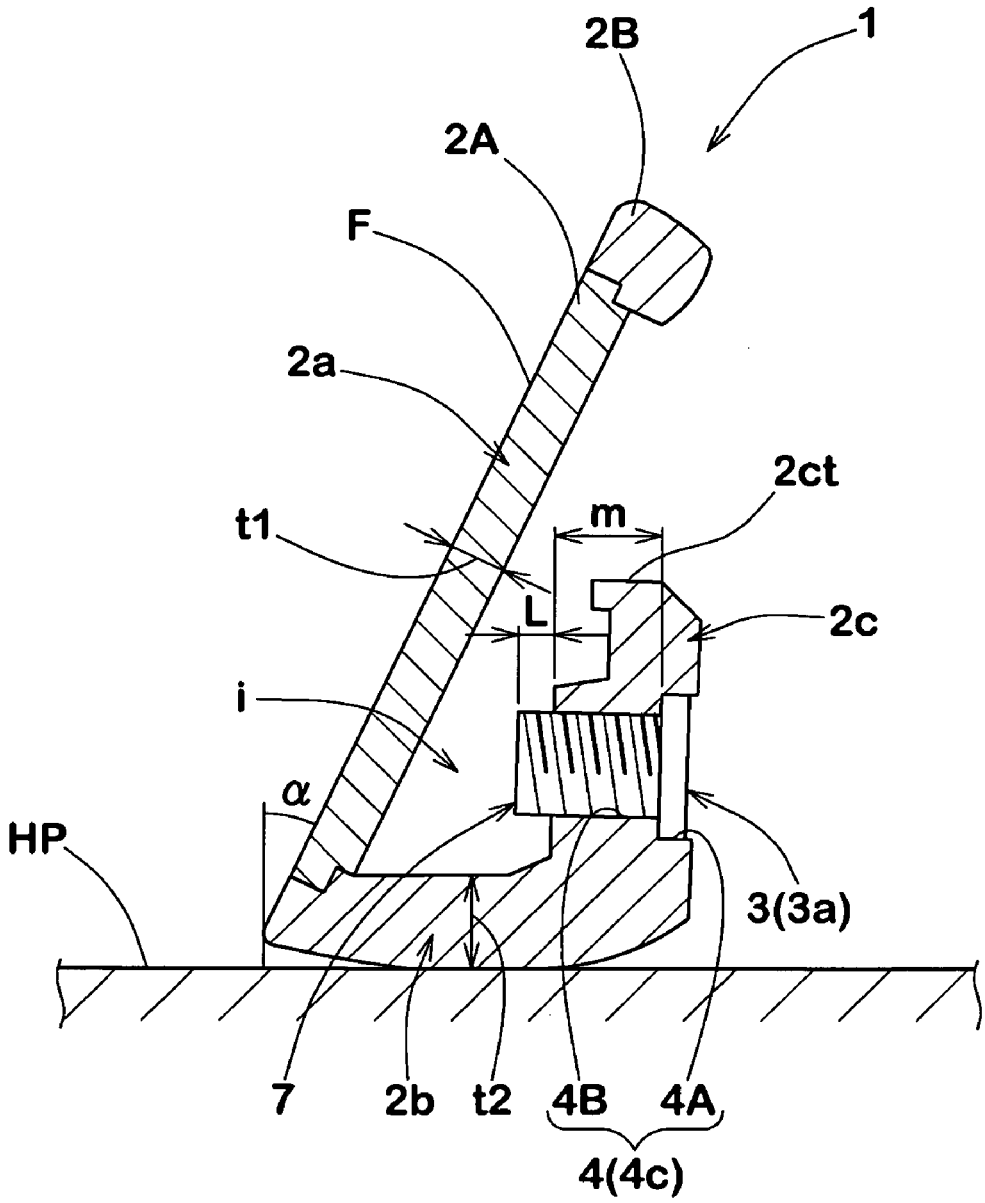
FIG. 4 is a cross sectional view along a line A-A in FIG. 3.

FIG. 4 shows a standard condition of a golf club head 1 (which may be, hereinafter, referred to simply as "club head"). The standard condition is a condition in which the club head 1 is placed on a horizontal plane HP with its lie angle and loft angle alpha. Further, FIGS. 2 and 3 show the club head 1 in a condition of being inclined such that a club face F becomes perpendicular from the standard condition.

The club head 1 in accordance with the present embodiment comprises a head main body 2 provided with a hole 4, and a damper 3 being detachably fixed to the hole 4 of the head main body 2.

In the present embodiment, the head main body 2 is structured as an iron type which includes a face portion 2*a* whose front face defines a club face F for hitting a ball, a sole portion 2*b* extending from a lower edge of the club face F toward a back face, a turnup wall 2*c* turned up at a rear side of the sole portion 2*b* so as to form a gap "i" behind the face portion 2*a*, and a hosel portion 2*d* being provided diagonally upward in a heel H side and to which a shaft (not shown) is installed.

The head main body 2 is preferably formed by a metal material. As the metal material, for example, a stainless steel (specific gravity: 7.8), a titanium alloy (specific gravity: 4.5), an aluminum alloy (specific gravity: 2.7), a soft iron (specific gravity: 7.9), a magnesium (specific gravity: 1.8) and the like are employed. Above all, the stainless steel, the titanium alloy or the soft iron is desirable. Further, in order to achieve a weight saving of the head main body 2, for example, a carbon fiber reinforced resin (specific gravity: 1.4) or the like may be employed partly. In this case, each of the specific gravities mentioned above is shown as a typical value.

In order to secure a good swing balance with suitable size of the head, the specific gravity $\rho m$ of the head main body 2 is preferably not less than 2.0, more preferably not less than 3.0, and further preferably not less than 4.0. Further, an upper limit of the specific gravity $\rho m$ is preferably not more than 10.0, more preferably not more than 9.0, and further preferably not more than 8.0. Here, in the case that the head main body 2 is not constituted by a single material, the specific gravity mentioned above employs an average specific gravity weighted by a volume of each of the materials constituting the head main body 2.

The head main body 2 in accordance with the present embodiment is constituted by a face plate 2A made of a titanium alloy and forming a main part of the face portion 2*a*, and a receiving frame 2B made of a stainless steel and having a front surface to which the face plate 2A is attached. Further, the receiving frame 2B is provided with the sole portion 2*b* and the turnup wall 2*c*. In the head main body 2 mentioned above, since a weight of the head is distributed much in a peripheral portion of the club face F, a sweet area is increased, and it is possible to improve a directionality of hit ball.

In this case, both the face plate 2A and receiving flame 2B are firmly attached, for example, by using an adhesion, a so-called "caulking" utilizing a plastic deformation, a pressure insertion utilizing an elastic deformation, a screwing, a welding or two or more joint means. The head main body 2, however, may be structured by a single material.

It is desirable that the face portion 2*a* has sufficient durability and repulsion performance (a performance of increasing a carry by bending suitably at a time of hitting the ball) with respect to a repeated ball hitting. From this point of view, it is desirable that a thickness t1 at the sweet spot S of the face portion 2*a* is, for example, not less than 2.0 mm, and more preferably not less than 2.5 mm, and it is desirable that an upper limit thereof is preferably not more than 4.0 mm, and more preferably not more than 3.5 mm. In this case, the sweet spot S is set to a nodal point between a normal line N perpendicularly drawn from a center of gravity G of the club head to the club face F and the club face F.

As shown in FIG. 4, the sole portion 2*b* in accordance with the present embodiment is exemplified by a structure in which a thickness t2 measured in a perpendicular direction is gradually increased toward a rear side of the club head. As mentioned above, it is possible to position the center of gravity of the club head to a rear side of the head by gradually increasing the thickness t2 of the sole portion 2*b* toward the rear side of the club head. Accordingly, it is possible to enlarge a center of gravity depth and to improve the directionality of the hit ball.

Figure 1:
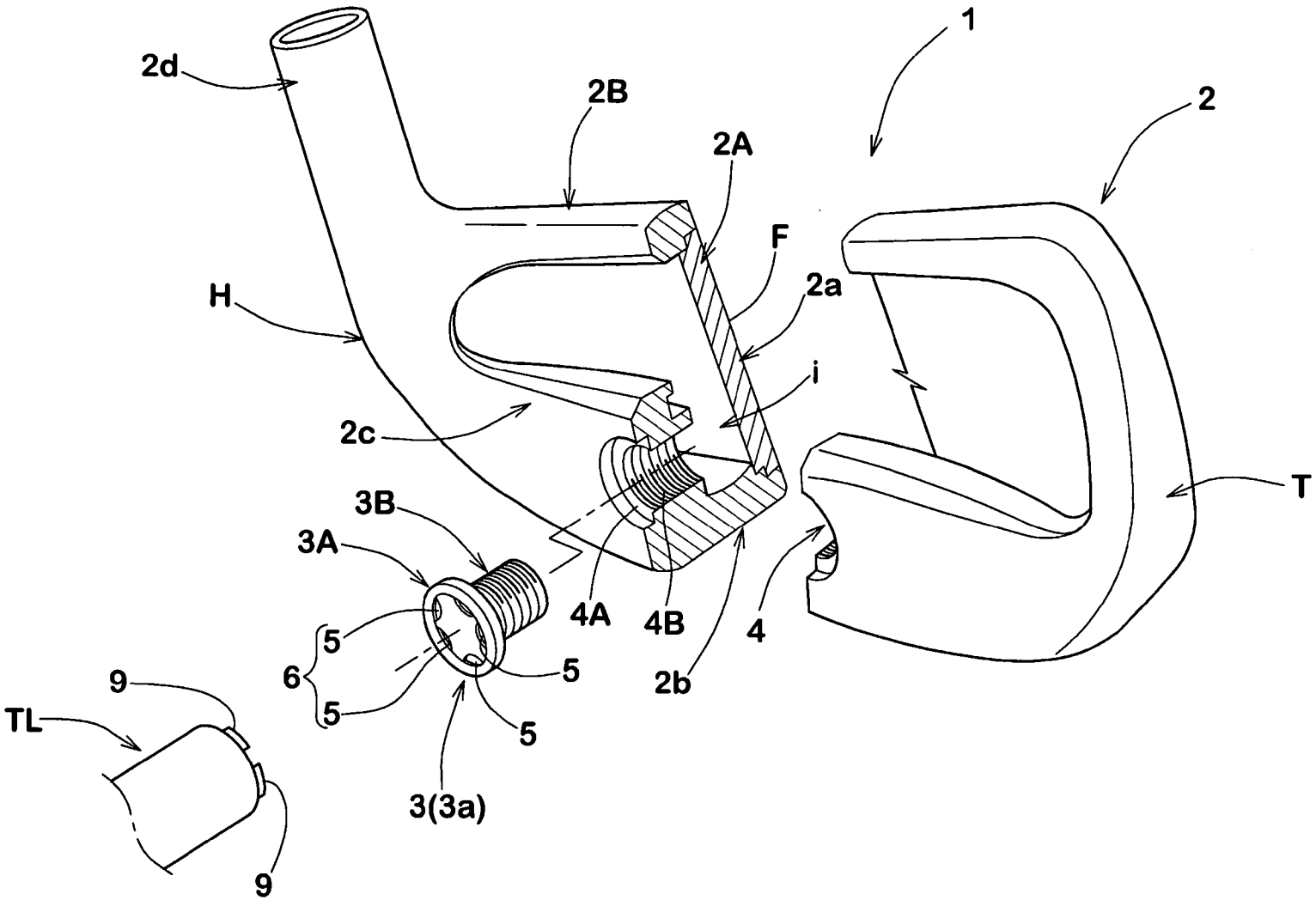
FIG. 1 is an exploded perspective view of an iron type club head showing the present embodiment.

The turnup wall 2*c* extends approximately perpendicularly toward an upper side at a rear end of the sole portion 2*b*, as shown in FIGS. 1, 3 and 4. In the present embodiment, an upper end 2*ct* of the turnup wall 2*c* is terminated without being in contact with the back surface of the face portion 2*a*. The turnup wall 2*c* mentioned above efficiently allocate more weight to a rear side and a bottom side of the club head.

Further, the gap i is formed between the turnup wall 2*c* and the face portion 2*a* as a so-called pocket-cavity extending in a toe and heel direction and having an upper opening. Since the gap i mentioned above provides a space in which the face portion 2*a* can bend sufficiently to a rear side of the club head at a time of hitting ball, the gap i can improve a head repulsion characteristic.

Further, in this embodiment, one hole 4 is provided in the turnup wall 2*c* of the club head 1.

The hole 4 is located by a center between a toe T and a heel H of the club head 1. An axial center line of the hole 4 is approximately perpendicular to the turnup wall 2*c*, and is approximately in parallel to the horizontal plane HP, as shown in FIG. 4. Further, the hole 4 is formed as a through hole passing through the turnup wall 2*c* back and forth. In this case, it may be constituted by a hole having an opening only in an outer surface of the turnup wall 2*c*.

In the present embodiment, the damper 3 comprises a head 3A, and a shank 3B having a smaller outer diameter than that of the head 3A and provided with a thread on its an outer surface.

In order to screw the damper to the hole 4 of the head main body 2, the hole 4 in accordance with the present embodiment comprises a socket portion 4A receiving the head 3A of the damper 3, and a main portion 4B with a helical groove on its inner surface engaging with the thread of the shank 3B. The socket portion 4A is opened on an outer surface of the club head, and the main portion 4B of the hole 4 extends toward the gap i. As for the shape of the thread, triangle, trapezoid, rectangular, serrated shape and circular shape may be employed.

In this present embodiment, the damper 3 can be firmly screwed to the hole 4 by engaging the thread of the shank 3B with helical groove of the main portion 4B of the hole 4 from an outer side of the head main body 2. At this time, the head 3B of the damper 3 is received in the socket portion 4A of the hole 4 without protruding from the outer surface of the turnup wall 2*c*. Further, since the head 3A of the damper 3 is closely contacted with the socket portion 4A, it is possible to firmly position the damper 3 in an axial direction. Above all, it is preferable that a peripheral surface of the head 3A is closely contacted with the socket portion 4A.

In this present embodiment, the head 3A of the damper 3 is formed in a disk shape. Further, the socket portion 4A of the hole 4 is formed by a circular hole so that the head 3A can be disposed therein. The head 3A of the damper 3 is provided with a slot 6 for rotating the detachable part 3 by a screwdriver. Since the head 3A of the damper 3 is visible from an outer portion, the slot 6 preferably comprises, for example, a plurality of (five in the present embodiment) concave portions 5 being uniformly disposed in the circumferential direction on its outer surface, in place of a plus screw or a minus screw. Such a slot 6 serves for improving the design of the club head 1. Further, the damper 3 can be screwed to the hole 4 by using a special tool TL having convex portions 7 corresponding to the concave portions 5. Accordingly, it is possible to easily install, detach and replace the parts 3, for example, by a golfer buying this club. Also, by strongly screwing the damper 3 to the hole 4, the thread of the damper 3 is closely engaged with the helical groove, and is brought into contact with the head main body 2 in a state of being exposed to a stress. Accordingly, the vibration of the head main body 2 generated at a time of hitting a ball is efficiently transmitted to the damper 3*b* via the hole 4.

Further, the damper 3 is made of elastic material at least partially for absorbing vibration of the head main body 2. Accordingly, the damper 3 can convert the vibration transmitted from the head main body 2 into a thermal energy on the basis of its own internal friction or the like, and damps the vibration of the head main body 2 quickly. Accordingly, the club head 1 in accordance with the present embodiment can provide an improved hitting feeling.

As the damper 3, a non-metal material, for example, a rubber, an elastomer, a resin and the like is preferably used.

As the rubber, natural rubber and synthetic rubber such as butadiene rubber, isoprene rubber, styrene-butadiene rubber, nitrile rubber and/or ethylene propylene diene rubber can be employed.

As the resin, polyethylene, polypropylene, polystyrene, polyvinyl alcohol, nylon 6.6, nylon 12, acrylic resin, epoxy resin, fluorocarbon resin and/or silicon resin can be employed.

Above all, in order to make the vibration or impact absorbing characteristic high and apply a sufficient strength to the thread, a thermoplastic elastomer having a soft segment and a hard segment is desirable for an elastic material of the damper 3.

As the thermoplastic elastomer mentioned above, the following elastomer is desirable: a styrene thermoplastic elastomer including a polystyrene as the hard segment, and a polybutadiene or a polyisoprene as the soft segment; an urethane thermoplastic elastomer (TPU) including a polyurethane as the hard segment, and a polyester or an ether as the soft segment; an ester thermoplastic elastomer (TPEE) including a polyester as the hard segment, and a polyether or an ester as the soft segment; an amide thermoplastic elastomer (TPA) including a nylon 12 as the hard segment, and a plasticizer or a polyether as the soft segment; or olefin thermoplastic elastomer. The thermoplastic polyurethane elastomer is particularly desirable in the light of the productivity.

Further, addition agent such as age resistor, ultraviolet absorber, light stabilizer and/or pigment, filler such as hydrozincite and/or barium sulfate, or oil may be mixed with the elastic material.

The damper 3 is preferably made of elastic material having a JIS-A hardness of not less than 60 degrees, more preferably not less than 70 degrees and further preferably not less than 80 degrees. On the other hand, the damper 3 is preferably made of elastic material having the JIS-A hardness of not more than 98 degrees and more preferably not more than 95 degrees. Thus, the damper 3 is firmly screwed to the hole 4 without loosening while keeping its vibration absorbing performance.

Figure 5A:
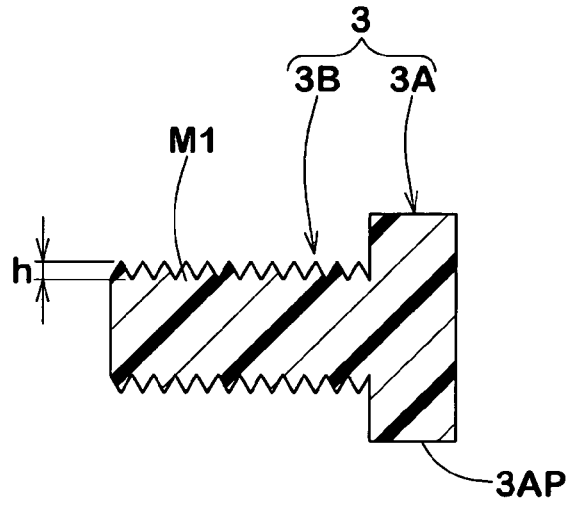
FIGS. 5(A) to 5(C) are cross sectional views showing an embodiment of a damper.
Figure 5B:
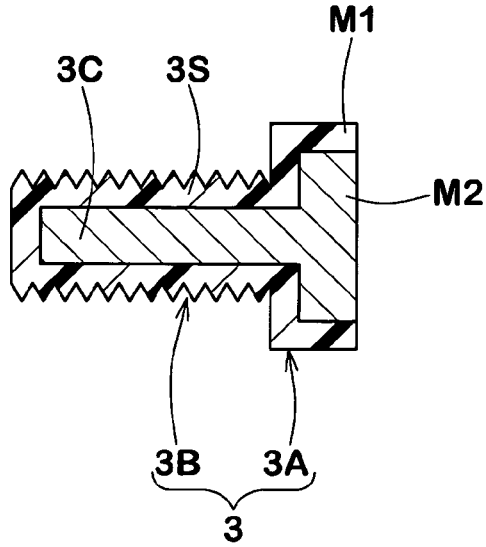

For example, the entire damper 3*b* is preferably structured by an elastic material M1, as shown in FIG. 5(A). However, as shown in FIG. 5(B), the damper 3*b* may comprise: a core 3C being made of metallic material M2 for increasing the strength of the damper; and a shell portion 3S being made of the elastic material M1 and contacting with the main body 2. In accordance with this embodiment, it is possible to further increase a durability of the damper 3*b*. In this case, if the elastic material M1 has a sufficient strength, the damper 3*b* may be formed as a hollow shape (not shown).

The specific gravity ρ2 of the damper 3 is preferably smaller than the specific gravity ρ1 of the head main body 2. If the specific gravity ρ2 of the damper 3 is too large, an increase of the weight of the club head 1 is caused. On the other hand, if the specific gravity ρ2 of the damper 3 is too small, the rigidity is lowered and the damper 3 may be broken due to the impact at a time of hitting the ball. From this point of view, the specific gravity ρ2 of the damper 3 is preferably not less than 0.5, more preferably not less than 0.7, and further preferably not less than 0.9, and an upper limit thereof is preferably not more than 2.2, more preferably not more than 2.0, and further preferably not more than 1.8.

Further, as shown in FIG. 4, the damper 3 has a protruding portion 7 protruding into the gap i from the hole 4. Particularly, it is desirable to make the protruding portion 7 execute a free vibration by setting the protruding portion 7 of the damper 3 to a cantilever condition. In other words, it is desirable that the protruding portion 7 of the damper 3*b* is provided in such a manner as to be prevented from being in contact with the back surface of the face portion 2*a* in both of the stationary state and the ball hitting state. Accordingly, the protruding portion 7 freely vibrates at a time of hitting the ball, and can further increase a vibration damping effect.

In order to keep the damping effect sufficiently without breaking due to the impact at a time of hitting the ball, an axial length L of the protruding portion 7 is preferably not less than 1.0 mm, more preferably not less than 2.0 mm, and further preferably not less than 3.0 mm, and is preferably not more than 20.0 mm, more preferably not more than 15.0 mm, and further preferably not more than 10.0 mm.

Figure 5C:
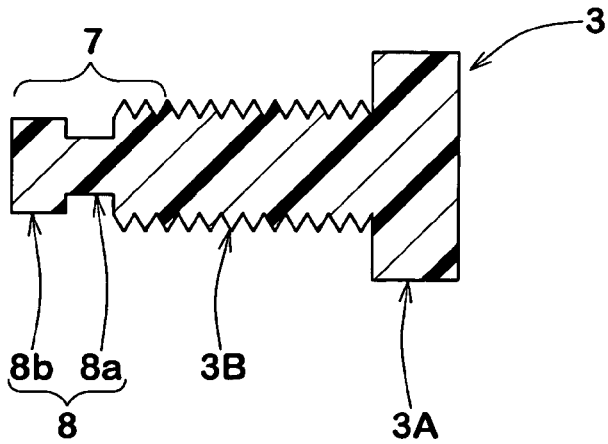

For example, as shown in FIG. 5(C), the damper 3 can be provided with a vibrator 8 including a large-diameter portion 8*b* having a great outer diameter and a neck 8*a* connecting between the large-diameter portion 8*a* and the screw part 3B with a small outer diameter. Since the large-diameter portion 8*b* can be greatly vibrated, the vibrator 8 mentioned above can further increase the vibration damping effect. In this case, the outer diameter of the large-diameter portion 8*b* is smaller than a thread diameter of the screw part 3B.

Figure 6:
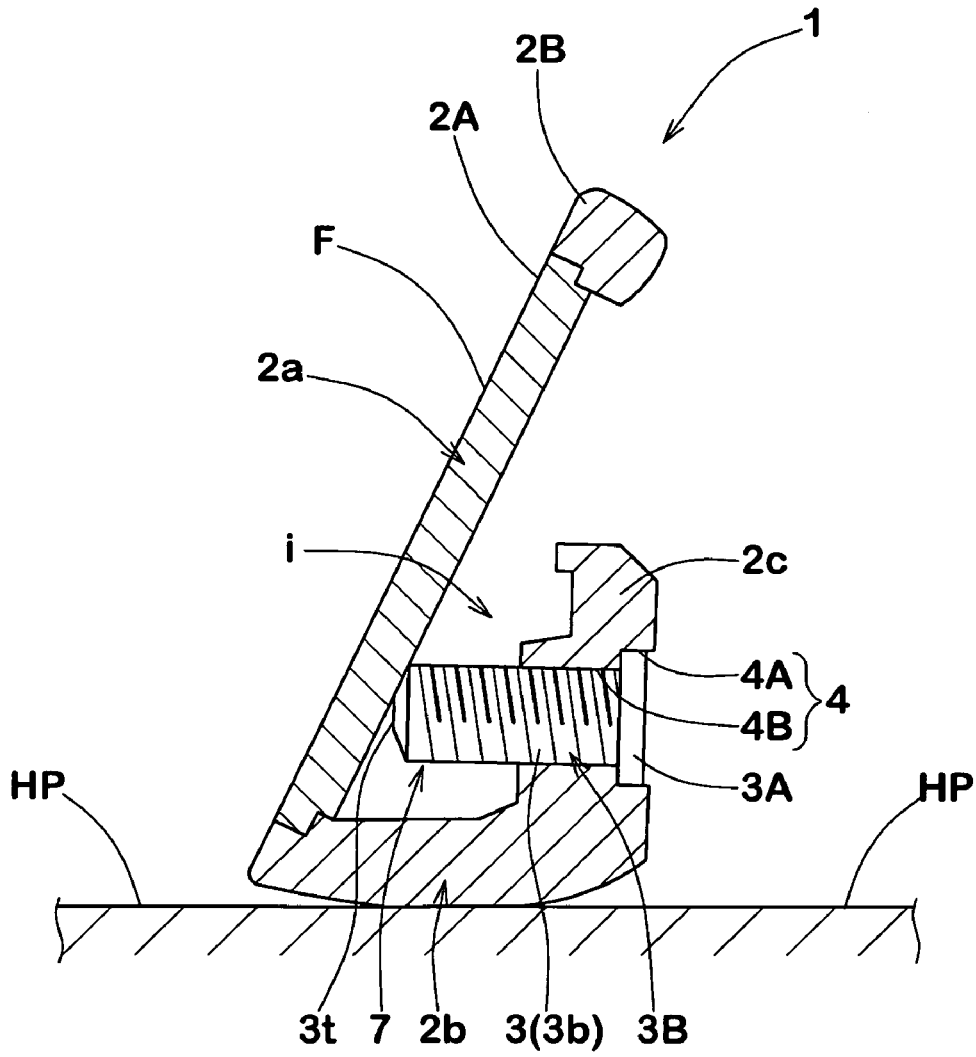
FIG. 6 is a cross sectional view along a line A-A in FIG. 3 showing another embodiment.

Further, as shown in FIG. 6, the leading end 3*t* of the protruding portion 7 may be brought into contact with the back surface of the face portion 2*a* so as to directly absorb the vibration of the face portion 2*a*.

In order to achieve a secure fixation between the damper 3 and the hole 4, as shown in FIG. 4, an axial length "m" screwing the damper 3 in the hole 4 is preferably not less than 2.0 mm, more preferably not less than 3.0 mm, and further preferably not less than 4.0 mm. If the length m becomes small, the connecting strength between the hole 4 and the damper 3 may be lowered. On the other hand, the detachable part 3 has a limitation in its length. Therefore, if the length m is too large, it is hard to form the protruding portion 7 executing the free vibration mentioned above. From this point of view, the length m is preferably not more than 10.0 mm, more preferably not more than 8.0 mm, and further preferably not more than 5.0 mm.

Further, in order to achieve a secure fixation between the damper part 3 and the hole 4, as shown in FIG. 5(A), the height h of the thread of the damper 3 or the hole is not less than 0.30 mm, more preferably not less than 0.40 mm, and further preferably not less than 0.50 mm, and an upper limit thereof is preferably not more than 3.0 mm, more preferably not more than 2.0 mm, and further preferably not more than 1.0 mm. The height h of the thread is obtained by an expression {(major diameter−root diameter)/2} in the screw part 3B, and is obtained by an expression {(root diameter−minor diameter)/2} in the hole 4.

The damper 3 can be made by various methods, such as pressing, injection molding, casting and machining processing. Especially, the thread of the damper 3 may be simultaneously formed at the time of its molding, or may be processed later.

Figure 7:
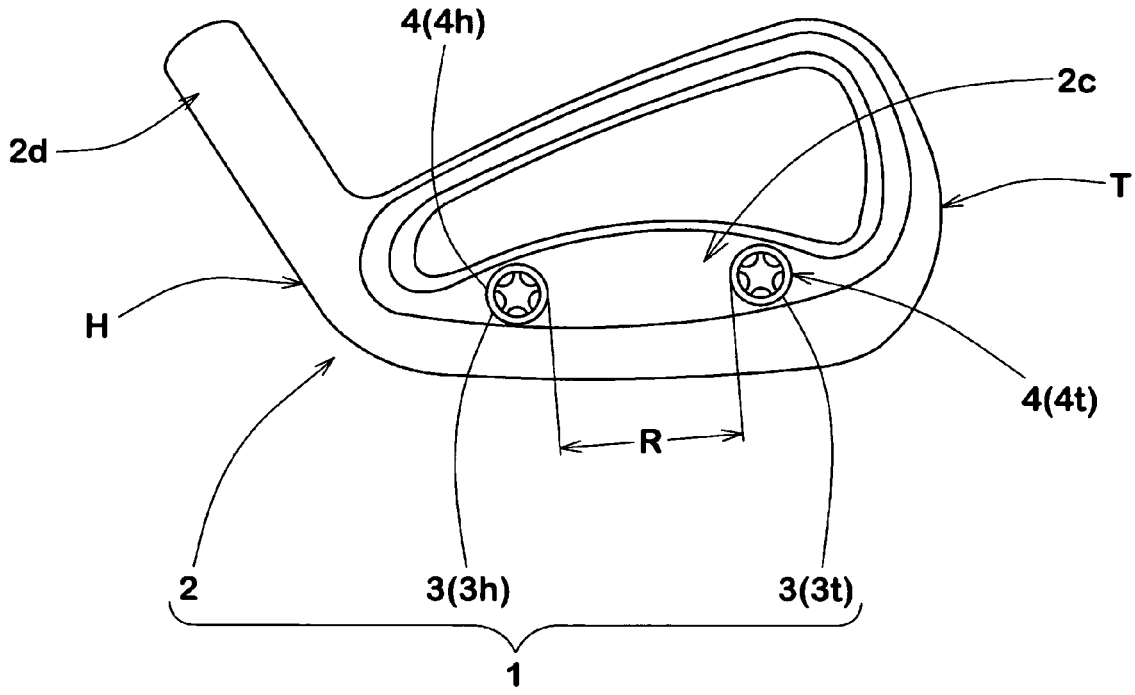
FIG. 7 is a back elevational view of a club head showing another embodiment in accordance with the present invention.

As shown in FIG. 7, the head main body 2 may be provided with a plurality of holes 4 and dampers 3. In this embodiment, holes 4 include a toe-side hole 4*t* being provided near the toe T, and a heel-side hole 4*h* being provided near the heel H. Also, dampers 3 include a toe-side damper 3*t* being screwed to the toe-side hole 4*t*, and a heel-side damper 3*h* being screwed to the heel-side hole 4*h*. In this embodiment, since vibration of the head main body 2 can be absorbed on both sides of the toe and the heel, a still better hitting feeling may be obtained. In this case, desirable specifications such as shape, material or the like of dampers 3 or holes 4 can be defined according to desirable specifications described above.

In this embodiment, dampers 3*t* and 3*h* are preferably formed as the same except for their weights. Similarly, holes 4*t* and 4*h* are preferably formed as the same. Therefore, by exchanging the screwed position of the dampers 3*t* and 3*h* each other, it is possible to change a position of the center of gravity of the club head 1. Above all, it is easy to make dampers 3*t* and 3*h* having different weights by changing each specific gravity of the core 3S shown in FIG. 5(B).

Figure 8:
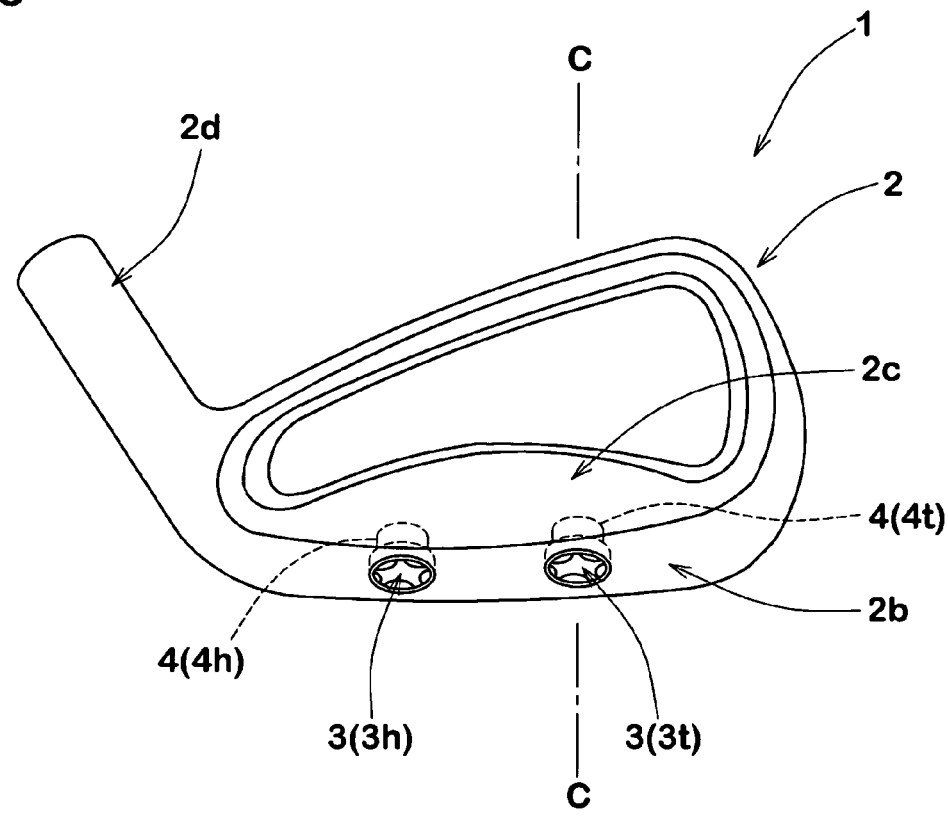
FIG. 8 is a back elevational view of a club head showing another embodiment in accordance with the present invention.
Figure 9:
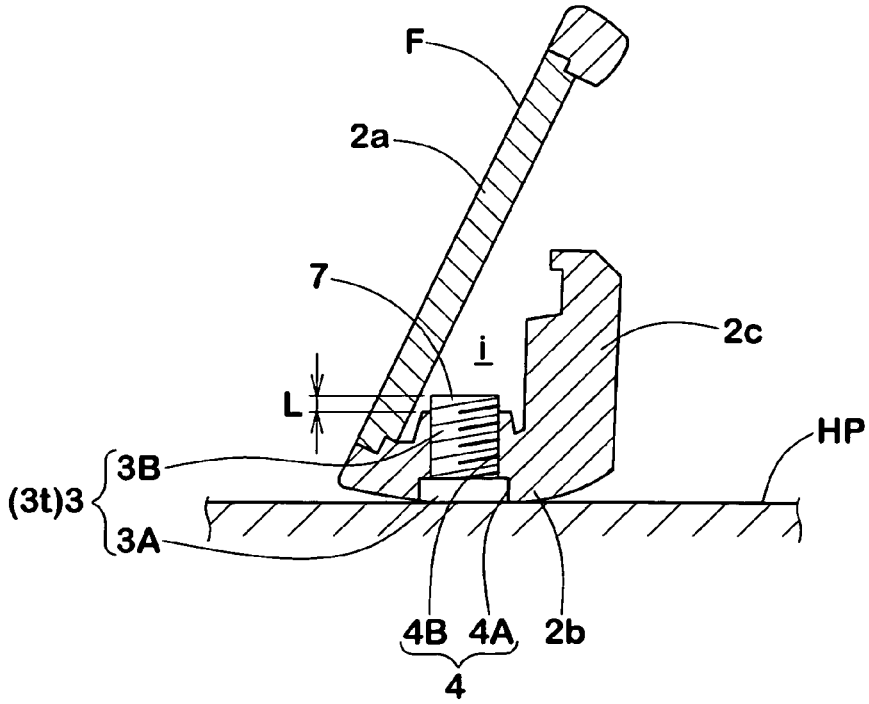
FIG. 9 is a cross sectional view along a line C-C in FIG. 8.

FIGS. 8 and 9 show another embodiment in accordance with the present invention. FIG. 9 is a cross sectional view along a line C-C in FIG. 8, and FIG. 8 shows the same condition as FIG. 3. In this embodiment, two holes 4*t* and 4*h* each with a damper 3*t* or 3*h* screwed thereto are provided on the sole portion 2*b* respectively. For example, the toe-side hole 4*t* and the heel-side hole 4*h* are provided in the sole portion 2*b*.

In general, since the sole portion 2*b* has a chance of being in contact with the ground at a time of hitting the ball, the greater impact force tends to be generated. Accordingly, the vibration at a time of hitting the ball can be effectively reduced by installing the damper(s) 3 to the sole portion 2*b* mentioned above.

The toe-side damper 3*t* and the heel-side damper 3*h* are screwed toward the gap i from the outer surface of the sole portion 2*b*. Accordingly, the head portion 3A of each damper 3 is accommodated in such a manner as to be approximately flush with the outer surface of the sole portion 2*b* without protruding from the socket 4A of each hole 4. Therefore, even if the sole portion 2*b* hit ground when swinging, the head portion 3A of each damper 3 does not interfere with the swing. Further, the screw part 3B of the damper 3 includes the protruding portion 7 protruding into the gap i from each hole 4*t* and 4*h*. Also, in this case, desirable specifications such as shape, material or the like of dampers 3 or holes 4 can be defined according to desirable specifications described above.

Further, in another embodiment (not shown), one hole 4 and a damper 3 screwed thereto may be provided both of the back-wall portion 2*c* and the sole portion 2*b*.

Figure 10A:
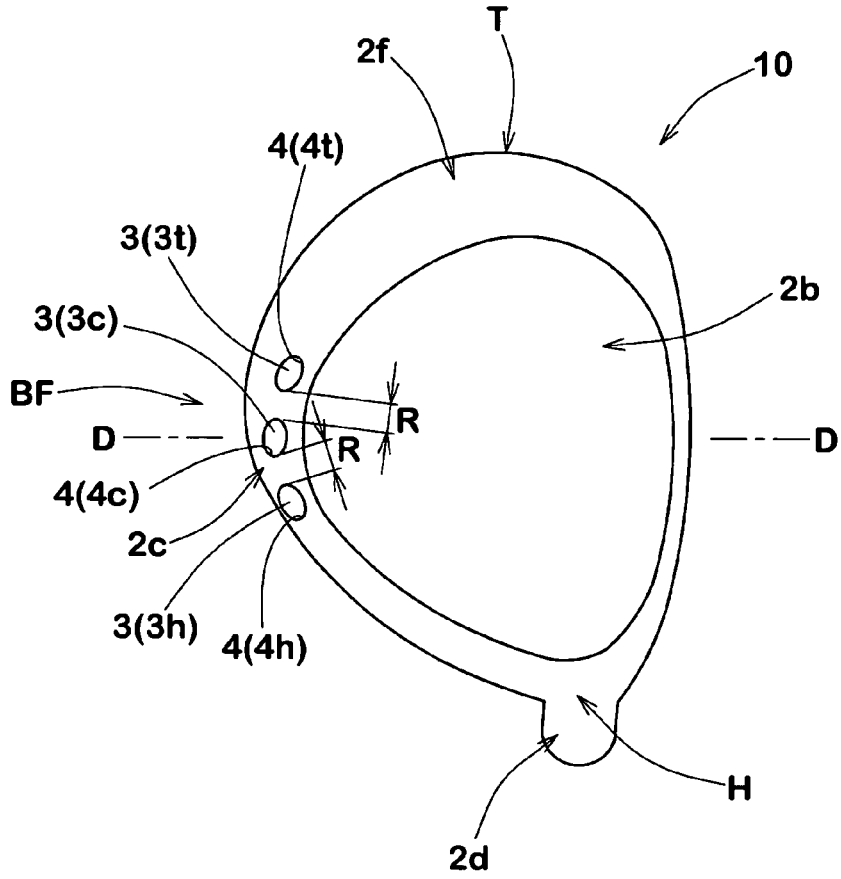
FIG. 10(A) is a bottom view of a wood type club head showing the other embodiment.
Figure 10B:
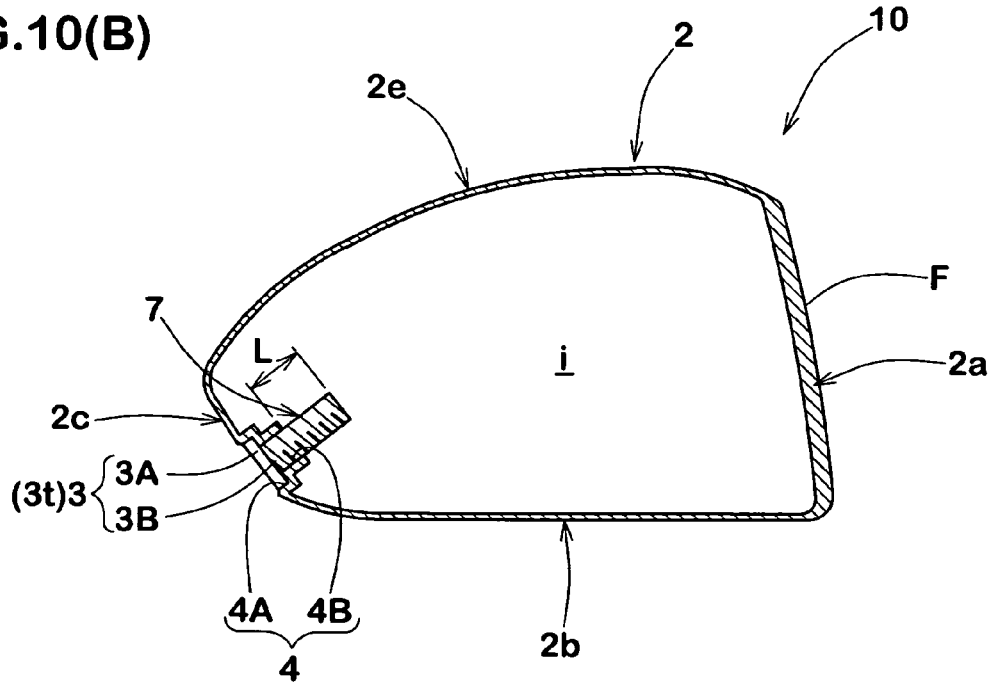
FIG. 10(B) is a cross sectional view along a line D-D in FIG. 10(A).

The present invention may be employed as a wood type golf club head 10, as shown in FIGS. 10(A) and 10(B).

The wood type golf club head 10 comprises a face portion 2*a* having a club face F, a crown portion 2*e* being connected to an upper edge of the club face F and forming a head upper surface, a sole portion 2*b* being connected to a lower edge of the club face F and forming a head bottom surface, a side portion 2*f* having a turnup wall 2*c* which extends from a rear end of the sole portion 2*b* upwardly so as to form a gap i behind the face portion 2*a*, and a hosel portion 2*d*. In this case, the gap i is formed as a substantially closed hollow portion.

The club head 10 is provided with three holes 4 in the turnup wall 2*c*. In more detail, a toe-side hole 4*t*, a heel-side hole 4*h* and an intermediate hole 4*c* interposed therebetween are provided in the turnup wall 2*c*. Further, three dampers 3 are screwed to holes 4 respectively toward the gap i from an outer surface of the club head 1. Positions of holes 4 are not limited to such an embodiment. Accordingly, holes 4 may be provided on the other position of the side portion 2*f* or the sole portion 2*b*.

In this embodiment, the protruding length of the damper 3 may be not more than 30 mm, more preferably not more than 25.0 mm, and further preferably not more than 20.0 mm, because the wood type club head 10 has a larger gap i than that of the iron type club head.

As to the number of the damper 3 (namely, it corresponds to the number of the hole 4), in order to efficiently absorb vibration of the head main body 2, two or more dampers 3 are preferably provided. On the other hand, if the number of the damper 3 is too great, a weight increase and the productivity of the club head 1 are deteriorated. Therefore, the number of the damper 3 is preferably not more than four, and more preferably not more than three.

Further, in a case that a plurality of holes 4 are provided on the head main body 2, a minimum distance R (shown in FIGS. 7 and 10) between the holes 4 being measured along the outer surface of the head main body 2 is preferably not less than 2.0 mm, and more preferably not less than 3.0 mm. If the minimum length R is too small, the strength between the hole of the head main body 2 becomes low, and the durability of the club head 1 deteriorates.

The description is given above of the embodiments in accordance with the present invention, however, it goes without saying that the present invention is not limited to the embodiments mentioned above, but can be executed by being modified to various aspects. For example, the club head includes a putter type and utility type. Further, the damper 3 may be painted. Also, adhesive agent may be used between the damper 3 and the hole 4.

Comparison Test:

In order to confirm the effect of the present invention, iron-type golf club for #5 with a loft angle of 24 degree were manufactured on the basis of the specification in Table 1 and tested for durability and hit feeling. A stainless steel with a specific gravity 7.8 was used in each head main body. As to the damper, a Thermoplastic polyurethane elastomer with JISA hardness of 80 degrees ("Elastoran C80A" manufactured by BASF Japan Co., Ltd.) was used. Furthermore, polyurethane adhesive agent ("Esplen H-25" made by Touritsu Kasei Industries, Ltd.) was used between the damper and the hole.

Further, the following references were also tested for comparison.

Reference 1:

The reference 1 was constituted by a club head having no hole and damper.

Reference 2:

The reference 2 was constituted by a club head having a damper and a hole based on the Example 1 as shown in Table 1. However, both the damper and the hole of the reference 2 had smooth surfaces without a thread and a helical groove. Accordingly, the damper was fixed to the hole using only the adhesive agent.

The test methods are as follows.

Hit Feeling Test:

First, the same shafts made of FRP were installed to each of test club heads, and the number 5 iron golf clubs were manufactured. Next, each of ten golfers having handicaps less than ten hit ten balls on a natural turf by using each of the test clubs, and an evaluation was executed a hit feeling. The hit feeling is evaluated on the basis of the following standard.

Very good: number of golfers feeling good is not less than 8

Good: number of golfers feeling good is from five to seven common: number of golfers feeling good is from two to four Bad: number of golfers feeling good is from less than two Durability Test:

The test club was attached to a swing robot and hit golf balls 3000 times at a head speed of 41 m/s. Then, the damper was visually checked.

Results of the tests are shown in Table 1.

As a result of the tests, it can be confirmed that each test head in accordance with the example an improved ball hitting feeling and durability.

TABLE 1

| | Ref. 1 | Ref. 2 | Ex. 1 | Ex. 2 | Ex. 3 | Ex. 4 | Ex. 5 | Ex. 6 | Ex. 7 | Ex. 8 |
|---|---|---|---|---|---|---|---|---|---|---|
| Layout of hole | — | FIG. 3 | FIG. 3 | FIG. 3 | FIG. 3 | FIG. 3 | FIG. 7 | FIG. 7 | FIG. 8 | FIG. 8 |
| Number of damper | 0 | 1 | 1 | 1 | 1 | 1 | 2 | 2 | 2 | 2 |
| Length m(mm) | — | 0 | 6 | 1 | 6 | 6 | 6 | 6 | 6 | 6 |
| Height of thread h(mm) | — | 0 | 1 | 1 | 1 | 0.2 | 1 | 1 | 1 | 1 |
| Protruding Length L(mm) | — | 0 | 3 | 3 | 1 | 3 | 1 | 3 | 1 | 3 |
| Minimum distance R(mm) | — | — | — | — | — | — | 20 | 20 | 15 | 15 |
| Ball hit feeling | Bad | Common | Very good | Very good | Good | Good | Very good | Very good | Very good | Very good |
| Durability *1 | — | CA | NP | NP | NP | NP | NP | NP | NP | NP |

*1 NP = Nothing Peculiar
DA = Came off after test

Next, wood-type golf club heads each with a volume of 460 cc were manufactured and were tested as well as iron-type golf club head, wherein the head main body with holes was a casting of Ti-6Al-4V, and each hole was given a helical groove on its inner surface by tapping. The material of the damper and the adhesive agent were the same as the specification of the test for iron-type golf clubs above.

Further, the following references were also tested for comparison.

Reference 3:

The reference 3 was constituted by a club head having no hole and damper.

Reference 4:

The reference 4 was constituted by a club head having a damper and a hole based on Example 9 shown in Table 2. However, both the damper and the hole of the reference 4 had smooth surfaces without a thread and a helical groove. Accordingly, the damper was fixed to the hole using only the adhesive agent.

The results and the specifications of the club heads are show in Table 2.

TABLE 2

| | Ref. 3 | Ref. 4 | Ex. 9 | Ex. 10 | Ex. 11 | Ex. 12 | Ex. 13 |
|---|---|---|---|---|---|---|---|
| Layout of hole | — | FIG. 10 | FIG. 10 | FIG. 10 | FIG. 10 | FIG. 10 | FIG. 10 |
| Number of damper | 0 | 3 | 3 | 3 | 3 | 3 | 3 |
| Length m(mm) | — | 0 | 6 | 6 | 6 | 6 | 6 |
| Height of thread h(mm) | — | 0 | 1 | 1 | 1 | 1 | 1 |
| Protruding Length L(mm) | — | 0 | 10 | 20 | 40 | 10 | 10 |
| Minimum distance R(mm) | — | 10 | 10 | 10 | 10 | 50 | 1 |
| Ball hit feeling | Bad | Common | Very good | Very good | Good | Good | Very good |
| Durability *1 | — | CD | NP | NP | BP | NP | BH |

*1 NP = Nothing Peculiar
CD = Came off during test.
BH = Break between holes
BP = Break at Protruding portion

The invention claimed is:

1. A golf club head comprising a head main body being provided with at least one hole having a helical groove on its inner surface, the head main body further comprising a face portion whose front face defines a club face for hitting a ball, a sole portion extending from a lower edge of the club face toward a back face of the club head and a turnup wall turned up at a rear side of the sole portion so as to form a gap behind the face portion, and wherein the hole is provided in the sole portion or the turnup wall, a damper having a thread on its outer surface and screwed to the hole, wherein an outer surface of the damper contacting the hole is made of elastic material for absorbing vibration of the head main body.

2. The golf club head according to claim 1, wherein the hole is opened on an outer surface of the head main body, and the damper is screwed in the hole from outside of the head main body.

3. The golf club head according to claim 1, wherein the head main body comprises a face portion whose front face defines a club face for hitting a ball and a gap being provided behind the face portion, and the damper comprises a protruding portion extending from the hole into the gap.

4. The golf club head according to claim 3, wherein an axial length of the protruding portion is in a range of from 1.0 to 30.0 mm.

5. The golf club head according to claim 3, wherein the protruding portion has an end which does not come into contact with the back surface of the face portion.

6. The golf club head according to claim 5, wherein the damper comprises a head, a shank being formed with the thread and a vibrator connected to the end of the shank, and the vibrator comprises a neck having a smaller diameter than that of the shank and a large-diameter portion connected to the end of the neck.

7. The golf club head according to claim 1, wherein an axial length screwing the damper in the hole of the head main body is in the range of from 2 to 20 mm, and a height of the thread of the damper is from 0.30 to 3.0 mm.

8. The golf club head according to claim 1, wherein the damper comprises a head and a shank being formed with the thread, the shank has an outer diameter smaller than that of the head, and the hole comprises a socket portion receiving the head of the damper without protruding the head to the outside thereof and a main portion in which the shank of the damper is screwed.

9. The golf club head according to claim 1, wherein the damper is screwed in the hole so as to come into contact with a back surface of the face portion through the gap.

10. The golf club head according to claim 1, wherein the entire damper is made of elastic material.

11. The golf club head according to claim 1 or 10, wherein said elastic material is a non-metal material.

12. The golf club head according to claim 11, wherein said elastic material has a JIS-A hardness in a range of from 60 to 98 degrees.

13. A golf club head comprising a head main body being provided with at least one hole having a helical groove on its inner surface, and a damper having a thread on its outer surface and screwed to the hole, and the damper being made of elastic material at least partially for absorbing vibration of the head main body, wherein the head main body comprises a face portion whose front face defines a club face for hitting a ball and a gap being provided behind the face portion, the damper comprises a protruding portion extending from the hole into the gap, and wherein the damper is screwed in the hole so as to come into contact with a back surface of the face portion through the gap.

14. The golf club head according to claim 13, wherein the entire damper is made of elastic material.

15. The golf club head according to claim 14, wherein said elastic material is a non-metal material.

16. The golf club head according to claim 15, wherein said elastic material has a JIS-A hardness in a range of from 60 to 98 degrees.

17. The golf club head according to claim 13, whefeinhe wherein the protruding portion has an end which does not come into contact with the back surface of the face portion.

18. The golf club head according to claim 13, wherein an axial length of the protruding portion is in a range of from 1.0 to 30.0 mm.

19. The golf club head according to claim 13, wherein an axial length of the protruding portion is in a range of from 3.0 to 10.0 mm.

* * * * *